US005866984A

United States Patent [19]

Doughty et al.

[11] Patent Number: 5,866,984

[45] Date of Patent: Feb. 2, 1999

[54] MERCURY-FREE ULTRAVIOLET DISCHARGE SOURCE

[75] Inventors: Douglas Allen Doughty, Charlton; Timothy John Sommerer, Ballston Spa, both of N.Y.

[73] Assignee: General Electric Company, Schenectady, N.Y.

[21] Appl. No.: 968,914

[22] Filed: Nov. 6, 1997

Related U.S. Application Data

[63] Continuation of Ser. No. 607,751, Feb. 27, 1996, abandoned.

[51] Int. Cl.[6] ..... H01J 61/16

[52] U.S. Cl. ..... 313/643; 313/485; 313/487; 313/572; 313/577

[58] Field of Search ..... 313/484, 485, 313/486, 487, 572, 576, 573, 577, 643, 637

[56] References Cited

U.S. PATENT DOCUMENTS

| | | | |
|---|---|---|---|
| 1,888,421 | 11/1932 | Beck . | |
| 2,207,174 | 7/1940 | Jenkins . | |
| 2,409,769 | 10/1946 | Leyshon . | |
| 2,476,616 | 7/1949 | Morehead . | |
| 2,622,221 | 12/1952 | Beese . | |
| 3,444,415 | 5/1969 | Skirvin . | |
| 3,536,945 | 10/1970 | Skirvin | 313/485 |
| 4,000,436 | 12/1976 | Toryu et al. | 313/487 |
| 4,032,813 | 6/1977 | Shurgan et al. | 313/643 |
| 4,039,889 | 8/1977 | Vacai | 313/487 |
| 4,107,571 | 8/1978 | Tanimizu et al. | 313/486 |
| 4,171,501 | 10/1979 | Tanimizu et al. | 313/486 |
| 4,461,981 | 7/1984 | Saikatsu et al. | 313/643 |
| 4,492,898 | 1/1985 | Lapatovich et al. | 313/637 |
| 4,636,692 | 1/1987 | Lapatovich et al. | 313/637 |
| 4,647,821 | 3/1987 | Lapatovich et al. | 313/637 |
| 4,710,679 | 12/1987 | Budinger et al. | 313/637 |
| 4,810,938 | 3/1989 | Johnson et al. | 315/248 |
| 4,882,520 | 11/1989 | Tsunekawa et al. | 313/643 |
| 4,937,503 | 6/1990 | Sigai et al. | 313/485 |
| 5,387,837 | 2/1995 | Roelevink et al. | 313/643 |

FOREIGN PATENT DOCUMENTS

| | | | |
|---|---|---|---|
| 0641015 | 7/1994 | European Pat. Off. | H01J 61/86 |
| 2219431 | 6/1989 | United Kingdom | H01J 65/04 |

OTHER PUBLICATIONS

"Fluorescent Lamp System," Yuasa Kunio; Ebara Hiroyuki; Kamei Taketo; Terajima Yoshiaki; Pub. No. 56084859; Pub. Date Jul. 10, 1981, Patent Abstracts of Japan.

"Investigation of Luminescent Materials Under Ultraviolet Excitation Energies from 5 to 25 eV", JK Berkowitz, JA Olsen,Journal of Luminescence 50 (1991) pp. 111–121.

"Rare–Gas Discharge Fluorescent Lamps Suitable for Industrial Uses", Yoshinori Anzai, Takehiko Sakurai, Takeo Saikatsu, Takashi Osawa, 5th International Symposium on the Science and Technology of Light Sources, York, England, 10–14, Sep., 1989.

"Model of a Weakly Ionized, Low–Pressure Zenon DC Positive Column Discharge Plasma", Timothy J. Sommerer, J. Phys. D: Appl. Phys. 29 (1996) pp. 769–778.

"Vacuum Ultraviolet Radiometry of Xenon Positive Column Discharges", DA Doughty and DF Fobare; Rev. Sci. Instrum. 66 (10), Oct. 1995, pp. 4834–4840.

*Primary Examiner*—Frank G. Font
*Assistant Examiner*—Michael Day
*Attorney, Agent, or Firm*—Jill M. Breedlove; Douglas E. Stoner

[57] ABSTRACT

A mercury-free ultraviolet (UV) discharge source includes an elongated envelope having a diameter in a preferred range from approximately 2 to 3 cm, containing a rare gas fill (xenon or krypton, including mixtures of these with other rare gases) at a pressure in a range from approximately 10 millitorr to approximately 200 millitorr and a power supply for ionizing the rare gas fill and generating a discharge current in a range from approximately 100 to approximately 500 milliamperes (mA). The UV discharge source has an efficiency and output comparable to existing mercury-based low-pressure discharge sources and is intended for use with a suitable phosphor capable of converting the UV radiation to visible light in a fluorescent lamp.

19 Claims, 6 Drawing Sheets

MERCURY-FREE ULTRAVIOLET DISCHARGE SOURCE

This application is a Continuation of application Ser. No. 08/607,751 filed Feb. 27, 1996 now abandoned.

The United States Government has certain rights in this invention pursuant to NIST Contract No. 70NANB3H1372.

FIELD OF THE INVENTION

The present invention relates generally to an ultraviolet discharge source and, more particularly, to such a discharge source which is mercury-free and is applicable to fluorescent lamps.

BACKGROUND OF THE INVENTION

The two principle figures of merit for a discharge as a source of ultraviolet (UV) radiation are radiant emittance (UV power per unit area at the wall of the discharge tube) and efficiency (UV power output per electric power input). In order to be practicable, a UV discharge source must have a high efficiency and a sufficiently high radiant emittance so that a discharge tube of practical size can produce the desired UV output. Such a UV discharge source which contains mercury is typically applicable to fluorescent lamps. Mercury-based fluorescent lamps provide energy efficient lighting in a broad range of commercial and residential applications. There is increasing concern, however, about the mercury from spent lamps entering the waste stream.

Accordingly, it is desirable to provide a mercury-free discharge source for UV radiation which exhibits high efficiency and high radiant emittance. Furthermore, it is desirable to provide a fluorescent lamp using such a mercury-free discharge source.

SUMMARY OF THE INVENTION

A mercury-free ultraviolet (UV) discharge source comprises an elongated envelope, which if circular in cross-section has a radius up to approximately 5 cm, preferably 2 to 3 cm, containing a xenon or krypton gas fill (including mixtures of these with other rare gases) at a pressure in a range from approximately 10 millitorr to approximately 200 millitorr and a power supply for ionizing the rare gas fill and generating a discharge current in a range from approximately 100 to approximately 500 milliamperes (mA). The UV discharge source has an efficiency and output comparable to existing mercury-based low-pressure discharge sources. One intended use for the invention is as a UV source in a fluorescent lamp. In this application, the discharge is combined with a suitable phosphor capable of converting the UV radiation to visible light.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
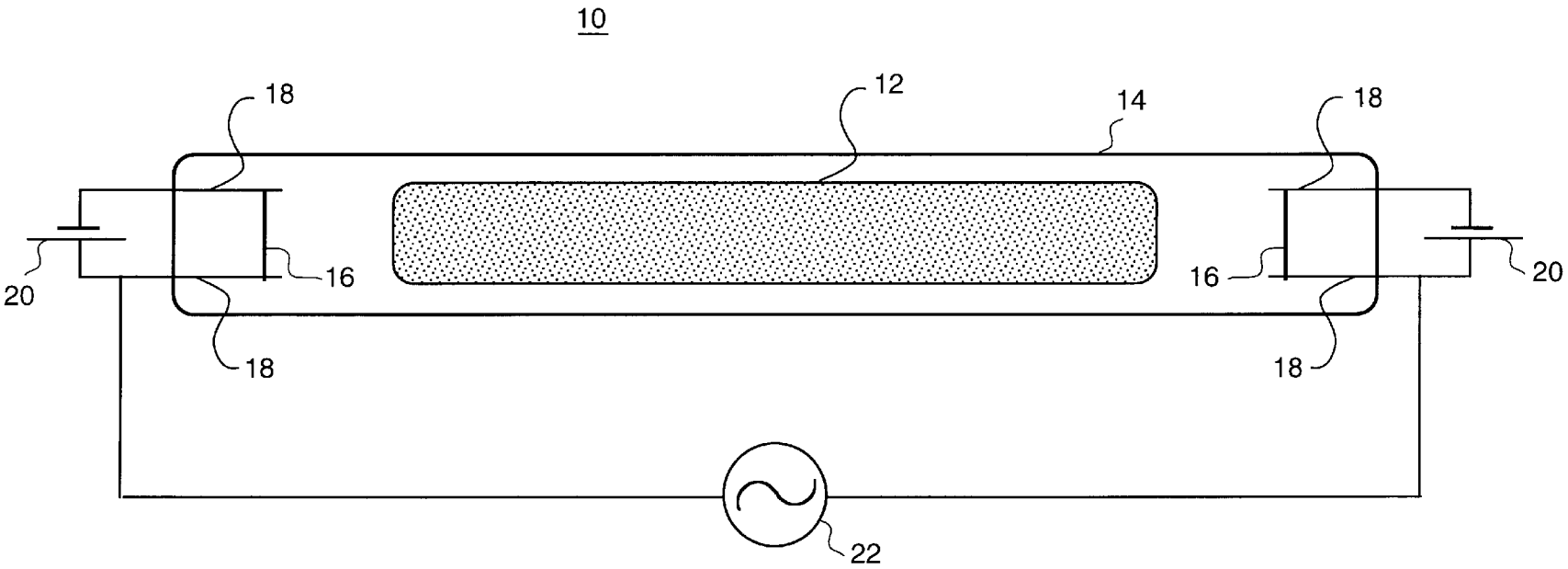
FIG. 1 schematically illustrates a UV discharge source in accordance with the present invention.

FIG. 1 schematically illustrates a mercury-free UV discharge source 10 having an efficiency and output comparable to existing mercury-based low-pressure discharges. FIG. 1 shows a positive column discharge plasma 12 contained in an elongated envelope 14 containing a rare gas fill. The material comprising the envelope 14 may be conducting or insulating, and transparent or opaque. The envelope 14 may have a circular or non-circular cross section, and it need not be straight The positive column is excited by thermionically emitting electrodes 16 which are mounted on lead wires 18 which pass out of the envelope 14. Electrically floating power supplies 20 supply current to the electrodes 16 so that, in combination with heat provided by the discharge, the electrodes are maintained at a temperature sufficient for thermionic emission of electrons. FIG. 1 illustrates excitation by a sinusoidal current from an external power supply 22; as such, the two electrodes each serve as a cathode for one-half the period of the sinusoidal excitation, and as an anode for the alternate half-period.

The properties of a positive column are independent of the excitation method. Furthermore, the properties of a dc discharge are very similar to that of an ac discharge, except at certain ac frequencies. In particular, the dc and ac discharges are similar when the ac excitation frequency is sufficiently high that the electron temperature does not vary appreciably over the ac cycle. At low ac frequencies the discharge reaches a quasi-steady-state at each time instant in the ac cycle which corresponds to dc operation at the same instantaneous discharge current. The example shown in FIG. 1 is an electroded, ac discharge with thermionic electrodes identical to those used on standard fluorescent lamps. However, the principles of the present invention apply to both hot (thermionic) and cold cathodes, and to using both dc and various time-dependent current waveforms (e.g., sinusoidal, square-wave, pulsed). Positive column discharges can also be excited without electrodes through the use of capacitive or inductive power coupling, or through other methods, such as surface wave discharges. Although the intrinsic efficiency of the positive column does not depend on the excitation method, the overall conversion efficiency (i.e., electrical power into UV radiation) is affected by losses in the excitation method.

In accordance with the present invention, the active discharge material has a vapor pressure such that the appropriate gas phase density can be obtained without undue effort in an elongated envelope suitable for a fluorescent lamp, such as that of FIG. 1, operating in a room-temperature ambient. In addition, the active discharge material must be compatible with typical lamp materials, e.g., glass, phosphor, and metallic electrodes, although some accommodation can be made through the use of protective coatings and/or the use of an electrodeless excitation scheme. Further, once in a vapor phase, the active discharge material must be capable of converting electron impact energy from the discharge into UV radiative emission. For fluorescent lamps, it is also desirable that the wavelength of the UV radiation be not much shorter than the wavelength of visible light (400–700 nm). (As a benchmark, existing fluorescent lamps excite phosphors with 185 and 254 nm radiation.)

Active discharge materials meeting the above criteria in accordance with the present invention are xenon and krypton, including mixtures of these with other rare gases. Such an active discharge material is contained in an elongated envelope having a diameter of up to approximately 5 cm, preferable 2 to 3 cm, at a pressure in a range from approximately 10 millitorr to approximately 200 millitorr, and operated with a power supply which generates a discharge current in a range from approximately 100 to approximately 500 milliamperes.

The inventors have employed a few methods for analyzing the output of a UV discharge source. For example, emission and absorption discharge spectroscopy has been used to quantitatively and directly estimate the UV output power, and electric probes have been used to estimate the discharge power deposition. The two values can be combined to give an electrical-to-UV conversion efficiency. These discharge diagnostics are summarized in "Vacuum Ultraviolet Radiometry of Xenon Positive Column Discharges" by D. A. Doughty and D. F. Fobare, *Rev. Sci. Instrum.* 66 (10), October 1995, which is incorporated by reference herein.

Another method the inventors have used for analyzing the output of a UV discharge source has been to make in-lamp measurements with a light meter, lamp electrical measurements (which include the electrodes), and measurements of the positive column electric field using a high impedance voltmeter connected to two conducting bands which each encircle the tube. The laboratory test lamp was a cylinder of soda-lime glass approximately 2.5 cm in diameter and 60 cm long, with standard fluorescent lamp electrodes attached to each end. The interior of the tube is coated with a blend of commercially available phosphor material. The light meter measures the eye-corrected luminous output from both the phosphor and the discharge itself.

Still another method the inventors have used for analyzing the output of a UV discharge has been to make a computational model of the atomic and discharge physical processes for application to rare gas positive column discharge systems. This model is summarized in "Model of a Weakly Ionized, Low Pressure Xenon DC Positive Column Discharge" by T. J. Sommerer, [J. Phys. D (in press)], which is incorporated by reference herein.

Figure 2:
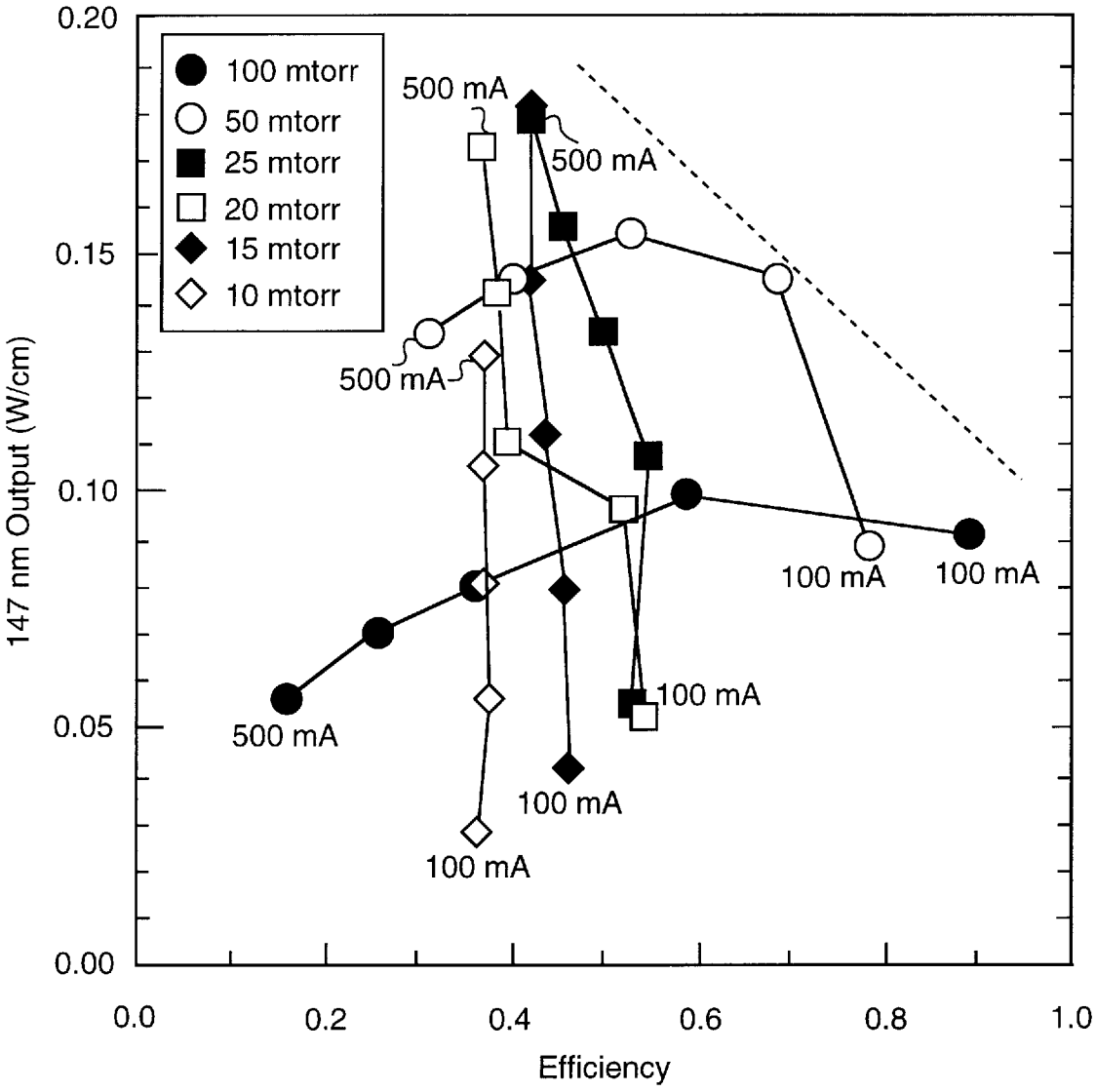
FIG. 2 graphically illustrates measured efficiency-power characteristics for a xenon UV discharge source in accordance with the present invention having an envelope with a diameter of 2.5 cm, the data points being in increments of 100 mA starting at 100 mA.

FIG. 2 illustrates measured efficiency/power characteristics for a xenon discharge in a UV discharge source 10 (FIG. 1). As shown by these graphs, discharges in pure xenon can yield efficiency output combinations comparable to mercury-based discharges. For example, a xenon discharge at approximately 50 millitorr and 200 mA produces 15 W/m of 147 nm radiation with an electrical-to-UV conversion efficiency of 0.70; at approximately 25 millitorr and 500 mA the output is 18 W/m and the efficiency is 0.45. This performance is comparable to the UV efficiency/output from the rare-gas/mercury discharge in a commercial GE F32T8 fluorescent lamp sold by General Electric Company.

In the context of xenon discharges, the UV output reported here is equal to the characteristic xenon emission near 147 nm. Xenon also emits characteristic UV radiation near 130 nm, although the inventors have found that the amount radiated at 130 nm is generally a small fraction (less than 25%) of the amount emitted at 147 nm.

In accordance with the present invention, there is a range of optimum UV efficiency-output combinations. The data in FIG. 2 indicates that one can trade off UV efficiency and output, and vice versa, depending on the application. For example, an application of a UV discharge source needing the highest efficiency can be obtained at 100 millitorr and 100 mA, but the output would be reduced from the highest obtainable output. Conversely, an application of a UV discharge source needing the highest output can be obtained at pressures below 50 millitorr and currents in excess of 500 mA, but the corresponding efficiency will be less than the highest obtainable efficiency. A plot of the UV efficiency-output in the manner of FIG. 2 therefore serves to define a characteristic line (shown as a dashed line in FIG. 2) which, for a given tube diameter, separates the range of physically realizable UV efficiency-output combinations (below and to the left of the dashed line) from the physically inaccessible UV efficiency-output combinations (above and to the right of the dashed line). A particular operating point within the physically realizable range of UV efficiency-output combinations is selected by appropriate choice of gas type, gas pressure, and discharge current. UV efficiencies and outputs along the characteristic line are optimum in the present context.

Note that for the case of highest efficiency (100 mA, 100 millitorr) the total output from the tube can be increased by increasing the length of the tube (and perhaps folding it back on itself to shorten its overall length). Thus, the loss in output per unit length at the highest efficiency can be recovered by adjusting the overall length of the tube.

It is observed under the conditions used in FIG. 2 that the discharge is not quiescent for pressures greater than 25 millitorr. At these higher pressures both the visible and UV outputs vary as a function of position along the tube. This spatial variation is accompanied by temporal variations having a frequency of approximately 2 kHz. This type of nonuniformity would be unacceptable for applications such as fluorescent lamps, which would appear to flicker under these conditions. For applications that depended on the average output over a characteristic time greater than approximately 10 to 100 msec, this variation would not be an issue. For pressures at or below 25 millitorr the spatial modulation of the discharge (as observed by the eye) disappears; there is still a temporal modulation, but at a much higher frequency (approximately 10 kHz), which would not cause noticeable flicker in a fluorescent lamp-type application.

Figure 3:
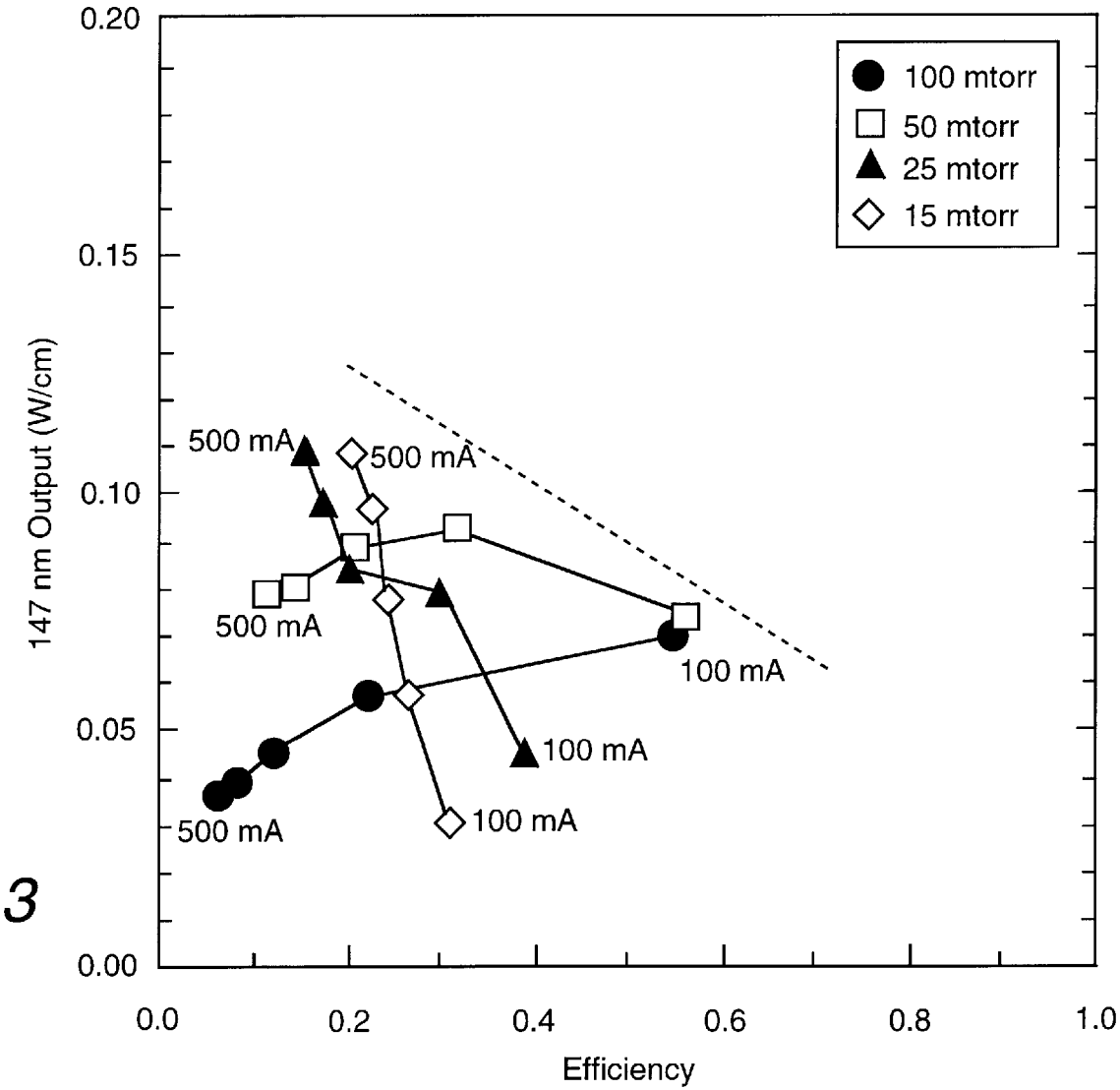
FIG. 3 graphically illustrates measured efficiency-power characteristics for a xenon UV discharge source in accordance with the present invention having an envelope with a diameter of 1.3 cm, the data points being in increments of 100 mA starting at 100 mA.

The results in FIG. 2 are for a cylindrical tube having a diameter of approximately 2.5 cm. Tubes with 1.3 and 5 cm have also been studied. At 1.3 cm the efficiency and output per unit length are lower than that for the 2.5 cm tube over the same range of pressures and currents (FIG. 3). At 5 cm tube diameter there is extensive spatial and temporal modulation of the visible and UV output for all currents and pressures studied. It was also observed that the axial electric field in the large diameter tubing was not uniform, which prevents an accurate direct characterization of the UV efficiency in such cases. Thus, a tube with a diameter of approximately 2 to 3 cm is the optimum size for applications such as a fluorescent lamp.

Krypton and xenon have similar atomic properties. Accordingly, a UV source containing krypton can be constructed using the same principles which have been described here for xenon. Krypton emits substantial UV radiation at 120 nm and 124 nm, with the radiated power more evenly split between these two emission lines. It is therefore appropriate to report the sum of the output at 120 nm and 124 nm and report this as the UV output when characterizing krypton discharges.

Figure 4:
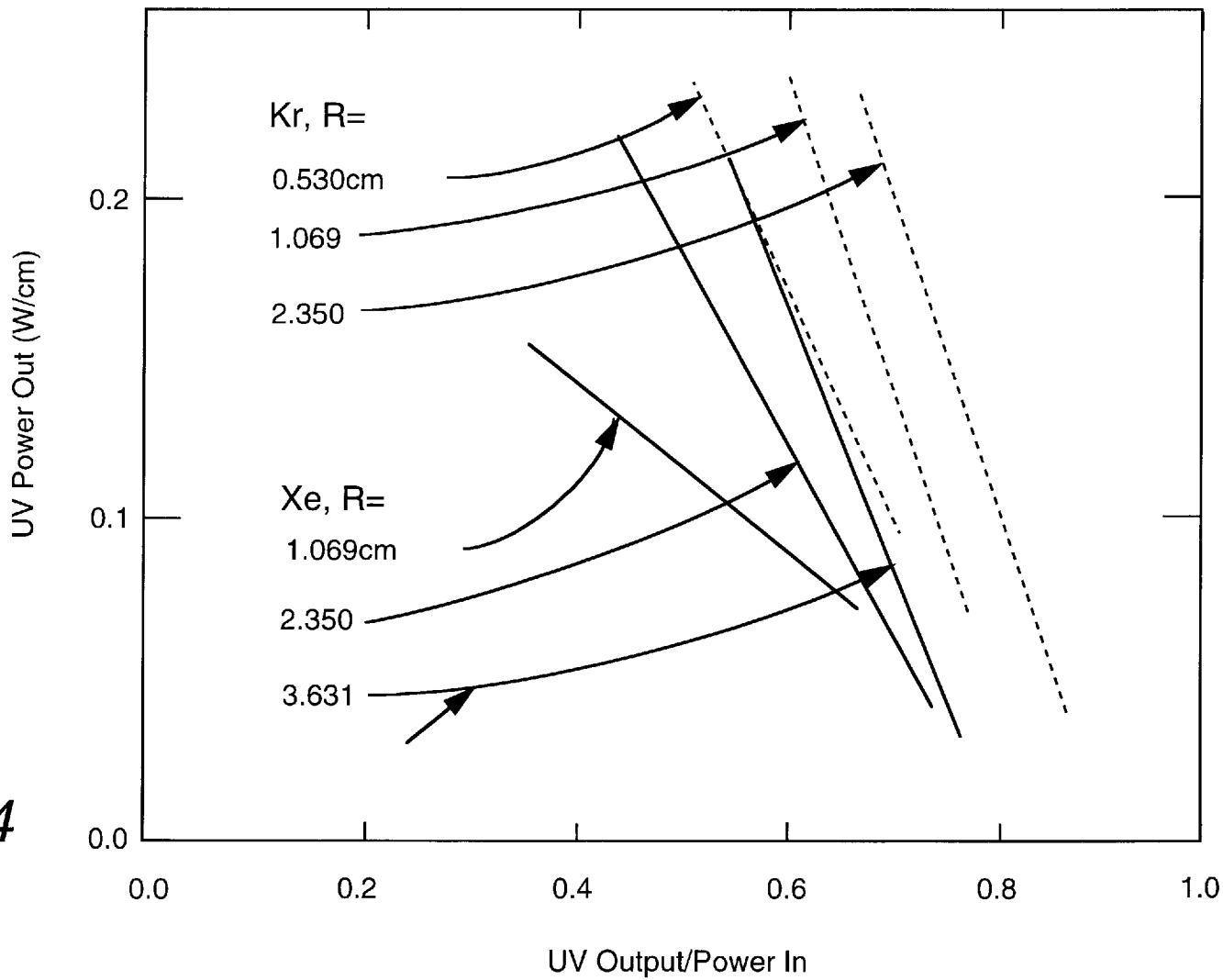
FIG. 4 graphically illustrates efficiency-power characteristics for xenon and krypton UV discharge sources as predicted by a numerical discharge model in accordance with the present invention.

The numerical discharge model predicts (FIG. 4) that, in the region of interest, comparable UV efficiency and output can be obtained from both xenon and krypton discharges via suitable choice of tube diameter, gas pressure, and discharge current. The model predictions indicate that krypton is capable of superior UV efficiency in small-diameter tubes. However, the UV efficiency and output of xenon and krypton are similar, and the choice of gas will depend upon the specifics of the desired application. The discharge model predictions are valid only for conditions where quiescent discharge operation can be obtained.

In addition to measuring the UV output directly, as represented in FIG. 2, this output can be obtained using a well-characterized phosphor to convert the UV emission into visible light, which is then measured using standard visible-light photometry methods.

Figure 5:
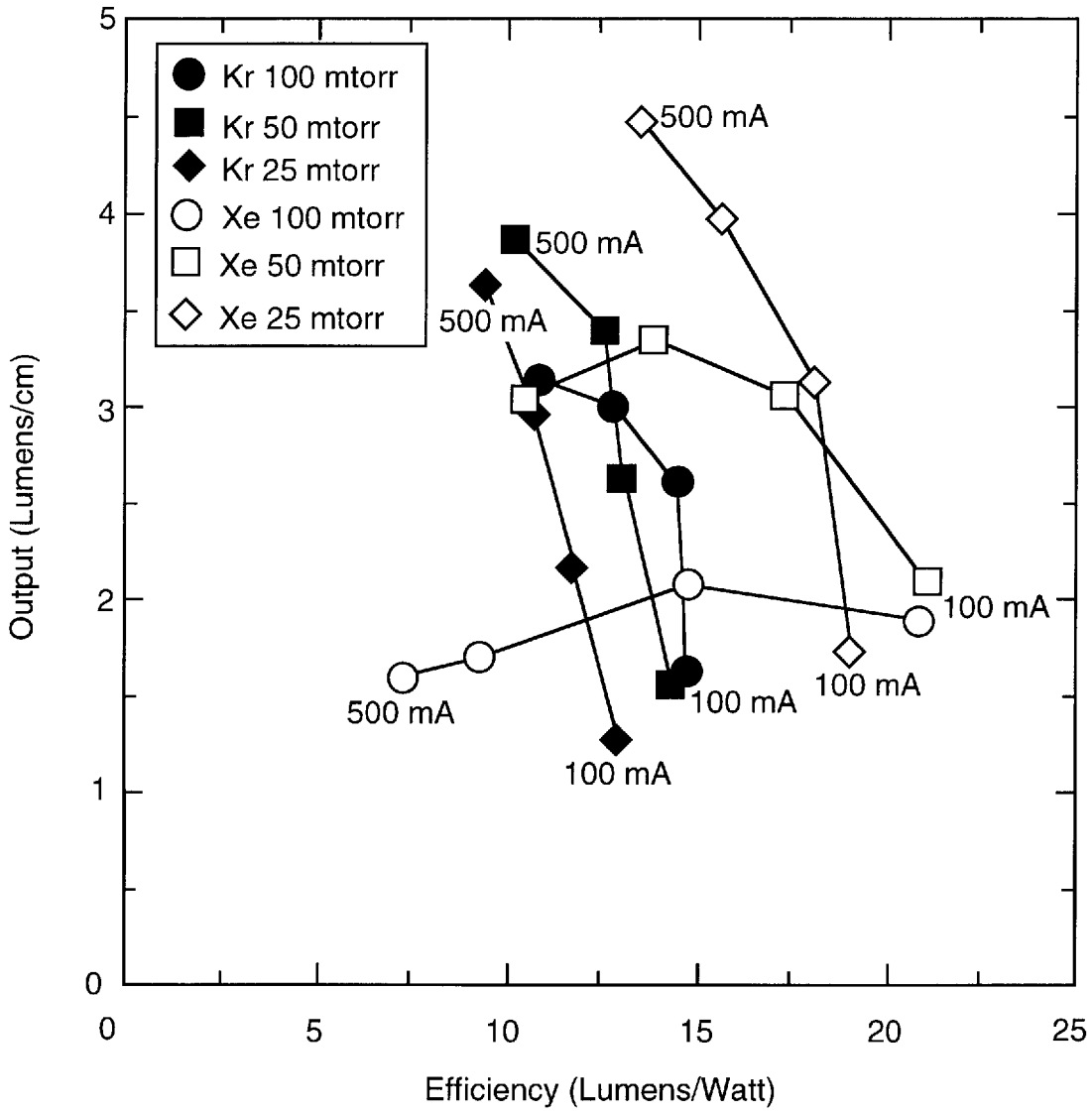
FIG. 5 graphically illustrates luminous output-efficacy characteristics for lamps in accordance with the present invention comprising krypton and xenon UV discharge sources and a commercially available phosphor coating on the inside of the envelope, the data points being in increments of 100 mA starting at 100 mA.

FIG. 5 graphically illustrates the measured luminous output of a lamp with a phosphor coating on the inside of the envelope suitable for converting UV radiation into visible light. Suitable phosphors include, for example, $Y_2O_3$:Eu (red emitter), $LaPO_4$:Ce:Tb (green emitter), and $BaMgAl_{10}O_{17}$:Eu (blue emitter). The lamp was attached to a vacuum and gas handling system for evacuation and subsequent backfilling with a selected pressure of a selected gas (xenon or krypton). A light meter was used to measure relative luminous output, which was then calibrated for one gas at a particular pressure and discharge current through the use of a photometric integrating sphere.

A comparison of FIG. 2 and the xenon results in FIG. 5 indicates that the phosphor conversion technique (FIG. 5) reproduces the trends observed using the direct UV measurement method (FIG. 2). Also as shown in FIG. 5, the phosphor conversion technique is useful for comparing the UV performance of xenon discharges with that of krypton discharge.

For conditions of equal discharge UV efficiency and output, it is to be expected that a lamp based on a krypton discharge would have a somewhat lower visible luminous efficiency and output in comparison with a lamp based on a xenon discharge. This difference in performance can be attributed to the difference in the Stokes shift energy loss incurred when the phosphor converts a photon of UV radiation of a given wavelength into a photon of visible light. The Stokes shift energy loss is greater when converting krypton radiation (110 nm and 124 nm) to visible light in comparison with the conversion of xenon radiation (130 nm and 147 nm) to visible light. Since the optimum UV efficiency and output is comparable in both xenon and krypton discharges (FIG. 4), it is to be expected, as shown in FIG. 5, that the visible luminous efficiency and output of a lamp incorporating a krypton discharge will be somewhat lower than a lamp incorporating a xenon discharge. The difference in performance can be calculated once appropriately weighted wavelengths are known for krypton UV emission, xenon UV emission, and visible luminous output.

Figure 6:
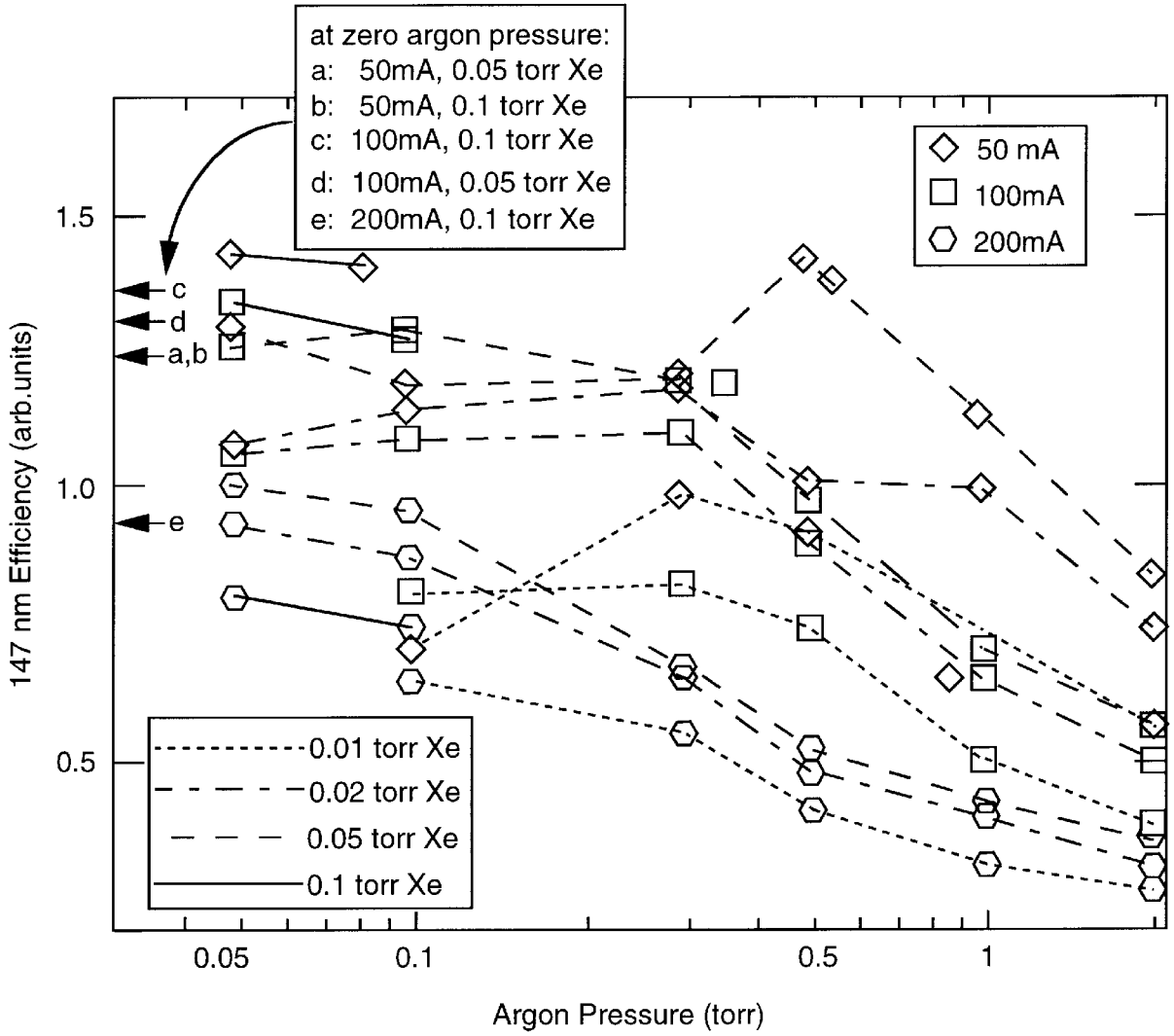
FIG. 6 graphically illustrates the relative efficiency for a UV discharge source containing a gas mixture of argon and xenon in accordance with the present invention.

For some applications it may be desirable that the UV source operate with a higher total gas pressure than approximately 200 millitorr. For example, the useful life of fluorescent lamp cathode designs used in existing fluorescent lamps decreases strongly as the total gas pressure is reduced below approximately 1 torr. However, FIG. 2 shows that xenon pressures above approximately 200 millitorr are not desirable for high UV output with good efficiency. In this case, an optimized UV source can be obtained using a mixture of xenon and a buffer gas such as argon or neon. Exemplary buffer gas pressures are in the range from approximately 0 to approximately 5 Torr. The addition of a buffer gas decreases the performance of the UV source, as shown in FIG. 6. However, for a given total gas pressure, the UV efficiency and output of a UV source containing a gas mixture can be higher than would be obtained from a UV source containing pure xenon at the same total pressure. The lighter rare gases are good choices in general for buffer gases because the threshold energy for energy loss during collisions between electrons and the buffer gas is larger than the threshold for electronic excitation of xenon. Accordingly, argon and neon are suitable buffer gases for xenon because they remain in their ground state and do not emit substantial UV radiation of their own. However, discharges in mixtures of xenon and krypton emit UV radiation due to both xenon and krypton. Helium is less desirable because an excessive fraction of the discharge power is lost to thermal heating of the helium atoms during elastic collisions between electrons and ground state helium atoms.

Similarly, neon and argon can be used as buffers to optimize krypton discharges. Helium is an unsuitable buffer for krypton for the same reasons as it is unsuitable for xenon.

The inventors have described here the UV efficiency and output from discharges in xenon, krypton, mixtures of xenon and a buffer gas, and mixtures of krypton and a buffer gas. The optimum choice of operating conditions (tube diameter, gas composition, gas pressure, discharge current, and discharge current waveform) can be selected based on the data contained herein and the use for which the present invention is employed.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A mercury-free ultraviolet discharge source, comprising:

an elongated envelope containing a gaseous fill for sustaining a discharge current and for emitting ultraviolet radiation as a result thereof, said fill comprising a mixture of xenon and at least one additional rare gas, xenon being at a pressure in a range from approximately 10 millitorr to approximately 200 millitorr, and said at least one additional rare gas being at a pressure in a range between 0 and 1500 millitorr, and a power supply for ionizing said fill and generating said discharge current in a range from approximately 100 to approximately 500 milliamperes; and operation of said discharge source being optimized with respect to a characteristic line on an efficiency-output curve based on tube configuration, fill composition, gas pressures, and discharge current.

2. The discharge source of claim 1 wherein said envelope comprises a cylinder having a diameter less than or equal to 5 cm.

3. The discharge source of claim 2 wherein said diameter is in a range from approximately 2 cm to approximately 3 cm.

4. The discharge source of claim 1 wherein said fill comprises xenon at a pressure from approximately 10 to approximately 50 millitorr.

5. The discharge source of claim 1 wherein said at least one additional rare gas is selected from a group consisting of argon, neon and krypton, including mixtures thereof.

6. The discharge source of claim 1 wherein said fill comprises krypton at a pressure from approximately 10 to approximately 100 millitorr.

7. A mercury-free ultraviolet discharge source, comprising an elongated envelope containing a gaseous fill for sustaining a discharge current and for emitting ultraviolet radiation as a result thereof, said fill comprising a mixture of krypton and at least one additional rare gas, krypton being at a pressure in a range from approximately 10 millitorr to approximately 200 millitorr, and said at least one additional rare gas being at a pressure in a range between 0 and 1500 millitorr;

a power supply for ionizing said fill and generating said discharge current in a range from approximately 100 to approximately 500 milliamperes; and operation of said discharge source being optimized with respect to a characteristic line on an efficiency-output curve based on tube configuration, fill composition, gas pressures, and discharge current.

8. The discharge source of claim 7 wherein said at least one additional rare gas is selected from a group consisting of argon, neon and xenon, including mixtures thereof.

9. The discharge source of claim 7 wherein said envelope comprises a cylinder having a diameter up to approximately 5 cm.

10. A mercury-free fluorescent lamp, comprising:

a light-transmissive, elongated envelope containing a gaseous fill for sustaining a discharge current and for emitting ultraviolet radiation as a result thereof, said fill comprising a rare gas selected from a group consisting of xenon and krypton, said rare gas being at a pressure in a range from approximately 10 millitorr to approximately 200 millitorr, said envelope having an interior phosphor coating for emitting visible radiation when excited by said ultraviolet radiation; and a power supply for ionizing said first rare gas and generating said discharge current in a range from approximately 100 to approximately 500 milliamperes; and operation of said lamp being optimized with respect to a characteristic line on an efficiency-output curve based on tube configuration, fill composition, gas pressures, and discharge current.

11. The mercury-free fluorescent lamp of claim 10 wherein said phosphor coating comprises a phosphor selected from a group consisting of $Y_20_3$:Eu, $LaPO_4$:Ce:Tb, and $BaMgAl_{10}O_{17}$:Eu.

12. The lamp of claim 10 wherein said envelope comprises a cylinder having a diameter less than or equal to 5 cm.

13. The lamp of claim 12 wherein said diameter is in a range from approximately 2 cm to approximately 3 cm.

14. The lamp of claim 10 wherein said fill comprises xenon at a pressure from approximately 10 to approximately 50 millitorr.

15. The lamp of claim 10 wherein said fill comprises a mixture of xenon and at least one additional rare gas, and said at least one additional rare gas is at a pressure in a range between 0 and 1500 millitorr.

16. The lamp of claim 15 wherein said at least one additional rare gas is selected from a group consisting of argon and neon including mixtures thereof.

17. The lamp of claim 10 wherein said fill comprises krypton at a pressure from approximately 10 to approximately 100 millitorr.

18. The lamp of claim 10 wherein said fill comprises a mixture of krypton and at least one additional rare gas, and said at least one additional rare gas is at a pressure in a range between 0 and 1500 millitorr.

19. The lamp of claim 18 wherein said at least one additional rare gas is selected from a group consisting of argon and neon including mixtures thereof.

* * * * *